United States Patent [19]

Jones

[11] Patent Number: 4,600,196

[45] Date of Patent: Jul. 15, 1986

[54] EXERCISING MACHINE WITH VARIABLE RESISTANCE

[75] Inventor: Arthur A. Jones, Lake Helen, Fla.

[73] Assignee: Nautilus Sports/Medical Industries, Inc., Lake Helen, Fla.

[21] Appl. No.: 664,080

[22] Filed: Oct. 24, 1984

Related U.S. Application Data

[63] Continuation-in-part of Ser. No. 459,508, Jan. 20, 1983, Pat. No. 4,500,089.

[51] Int. Cl.[4] ..... A63B 21/00

[52] U.S. Cl. ..... 272/134; 272/142; 272/136

[58] Field of Search ..... 272/136, 141, 142, 143, 272/134, 93, 116, 130, 135, 137, 138, 139; 128/25 R

[56] References Cited

U.S. PATENT DOCUMENTS

| | | | |
|---|---|---|---|
| 2,223,309 | 11/1940 | Swanson | 272/141 |
| 3,662,602 | 5/1972 | Weiss | 272/142 X |
| 3,858,873 | 1/1975 | Jones | 272/134 X |
| 4,066,259 | 1/1978 | Brentham | 272/130 X |
| 4,114,610 | 9/1978 | Koch | 128/25 R |
| 4,208,049 | 6/1980 | Wilson | 272/141 X |
| 4,231,568 | 11/1980 | Riley et al. | 272/136 |
| 4,387,894 | 6/1983 | Baumann | 272/130 |
| 4,402,505 | 9/1983 | Young | 272/143 X |
| 4,405,128 | 9/1983 | McLaughlin et al. | 272/143 X |
| 4,466,613 | 8/1984 | Reese | 272/136 X |

FOREIGN PATENT DOCUMENTS

| | | | |
|---|---|---|---|
| 604340 | 6/1960 | Italy | 272/142 |

*Primary Examiner*—Richard J. Apley
*Assistant Examiner*—Robert W. Bahr
*Attorney, Agent, or Firm*—Bell, Seltzer, Park & Gibson

[57] ABSTRACT

This exercising machine is particularly adapted for exercising the abdominal muscles of the user and is of a relatively lightweight construction adaptable for home use. The machine includes an exercising lever supported for pivotal movement in an arcuate path during each exercising movement and a resistance force is provided in the form of elongate resilient members. Variable numbers of the elongate resilient members are selectively connectable to the exercising lever for varying the amount of resistance force being applied to the exercising lever when it is moved by the user. A variable radius cam is interposed between the resistance force and the exercising lever so that the amount of resistance force required to move the exercising lever is varied throughout the various positions of the pivotal arc of movement of the exercising lever.

20 Claims, 6 Drawing Figures

EXERCISING MACHINE WITH VARIABLE RESISTANCE

This application is a continuation-in-part of applicant's application Ser. No. 459,508, filed Jan. 20, 1983, now U.S. Pat. No. 4,500,089.

FIELD OF THE INVENTION

This invention relates generally to an exercising machine including an exercising lever with one end positioned in a convenient location to be moved by the user against a resistance force. The particular exercising machine disclosed in the present application is adapted for exercising the abdominal muscles and is provided with manually operable selector means which is easily adjusted by the user to vary the amount of resistance force applied to resist movement of the exercising lever.

BACKGROUND OF THE INVENTION

Many different types of exercising machines currently in use are provided with one or more exercising levers operatively connected to a resistance force in the form of a weight stack. The user can vary the amount of resistance force applied to the exercising lever by varying the number of weights operatively connected to the exercising lever. However, the weight stack used in this type of exercising machine is expensive to produce and the weights increase the overall weight of the exercising machine.

Also, the resistance force applied by the weights connected to the exercising lever produces the same amount of resistance force in all angular positions of movement of the exercising lever so that the resistance force is applied in a uniform manner throughout the full range of movement of the exercising lever. Thus, the maximum resistance force which can be applied by the weights is limited to the maximum amount of resistance force which can be overcome by the weakest position of the particular muscles being exercised by the user. With this type of uniform resistance, the weakest position of the muscle receives the maximum amount of exercise while the strongest position of the muscle receives a minimum amount of exercise and the muscle is not worked to its capacity.

In order to overcome this limitation, a group of different types of exercising machines has been developed in which a variable radius cam is interposed between the weight stack and the exercising lever so that "full range" exercise of the muscles is obtained. In this type of exercise machine, the amount of resistance force being applied in various positions of the exercising lever is varied so that the muscles of the user are subjected to the proper amount of resistance force in all positions of movement to provide a much more effective "full range" exercising program. Examples of this type of exercising machine are disclosed in U.S. Pat. Nos. 3,858,873; 4,387,893; and 4,456,245.

It is also known to provide exercising machines with the resistance force being provided by elastic cords or springs, such as for example the exercising devices disclosed in U.S. Pat. Nos. 1,750,549; 1,866,868; and 3,770,267. However, these exercising devices still provide a substantially uniform resistance force throughout at least the middle range of movement of the muscles of the user. Also, it is difficult for the user to accurately and properly adjust the amount of resistance force applied by the elastic cords or springs in this type of machine.

Exercising machines have also been provided with resistance force in the form of hydraulic valves, cylinders or pistons and the like. Examples of exercising machines of this type are illustrated in U.S. Pat. Nos. 3,529,474; 3,784,194; and 3,848,467. Exercising machines have also been provided with resistance force in the form of brake devices in which a brake shoe is pressed against a rotating disk, as for example the exercising machine disclosed in U.S. Pat. No. 3,074,716. However, these types of exercising machines also apply a uniform resistance force to the exercising lever in all positions of movement of the lever so that these types of exercising machines do not provide the most efficient "full range" exercise. Also, the hydraulic valves, cylinders or pistons, as well as the brake devices, are expensive and it is difficult for the user to adjust these devices to provide the proper amount of resistance force to be imparted to the exercising lever.

SUMMARY OF THE INVENTION

With the foregoing in mind, it is an object of the present invention to provide an exercising machine with a variable resistance in the form of a plurality of elongate resilient or elastic members positioned in side-by-side relationship and with one end of each of the elastic members being connected in a fixed position and with selection means being associated with the other ends of the elastic members for varying the effective length of the elastic members by varying the number of the elastic members operatively connected to the exercising lever and for thereby varying the resistance force required to move the exercising lever a given amount of pivotal movement.

The exercising machine of the present invention also preferably includes a variable radius cam interposed between the resistance force applying elastic members and the exercising lever so that the amount of force applied during various positional movements of the exercising lever is varied during each exercising stroke.

The particular exercising machine disclosed in the present application is adapted for exercising the abdominal muscles and includes an upstanding main frame section with the lower portion being supported on a floor or the like. A seat is supported for vertical adjustment on the upper portion of the upstanding main frame. A substantially U-shaped auxiliary frame is fixed at its lower medial portion to the front portion of the main frame and includes upstanding legs extending rearwardly at an acute angle and forwardly of the seat. The upper ends of the legs terminate above the level of the seat and at a level corresponding with the waist of the user.

A substantially U-shaped exercising lever has opposite end portions of the legs thereof pivotally connected to the upper ends of the upstanding legs of the auxiliary frame and cushioned pads are adjustably supported on the medial portion of the exercising lever. The exercise lever is normally positioned in substantially a right-angular relationship with the upstanding legs of the auxiliary frame with the cushioned pads in position to be engaged by the forward portions of the shoulders of the user when in an upright seated position on said seat. Variable resistance force means is operatively connected to the exercising lever for resisting movement of the exercising lever forwardly and downwardly in a positive exercising movement and for applying a resistance force to the upper body of the user when moving upwardly and rearwardly to an upright seated position during a negative exercising movement. However, it is to be understood that the variable resistance force applying means of the present invention can also be applied to other types of exercising machines.

The variable resistance force means of the present invention includes a plurality of individual elongate resilient or elastic members with one end of each resilient member being fixed on the machine frame and with the opposite ends of a selected number of the resilient members being operatively connected to the exercising lever and normally being in contracted condition to normally maintain the exercising lever in a first position of an arcuate path of movement. The number of resilient members connected to the exercising lever determines the amount of predetermined resistance force resisting movement of the exercising lever to a second position. The elongate resilient members are stretched by the user as force is applied to the exercising lever during movement of the exercising lever to the second position. The elongate resilient members include a plurality of elastic members positioned in side-by-side relationship with one end of each of the elastic members being connected in a fixed position to the machine frame. Selection means is associated with the other ends of the elastic members for varying the amount of resistance force applied to the exercising lever means by varying the number of elastic members which are connected to the exercising lever. The selection means may be manually positioned by the user for selectively connecting different members of the elastic members to the exercising lever to thereby vary the resistance force required to move the exercising lever, between the first and second positions.

The elastic members comprise elastic cord members which are each maintained in a substantially U-shaped configuration by stamped metal retaining and guide members. The cord retaining and guide members are each provided with selector pin engaging openings spaced apart on one end and being adapted to be selectively engaged by a manually insertable selector pin for determining the number of the elastic cords which are operatively connected to the exercising lever and/or the variable radius cam interposed between the variable resistance device and the exercising lever.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
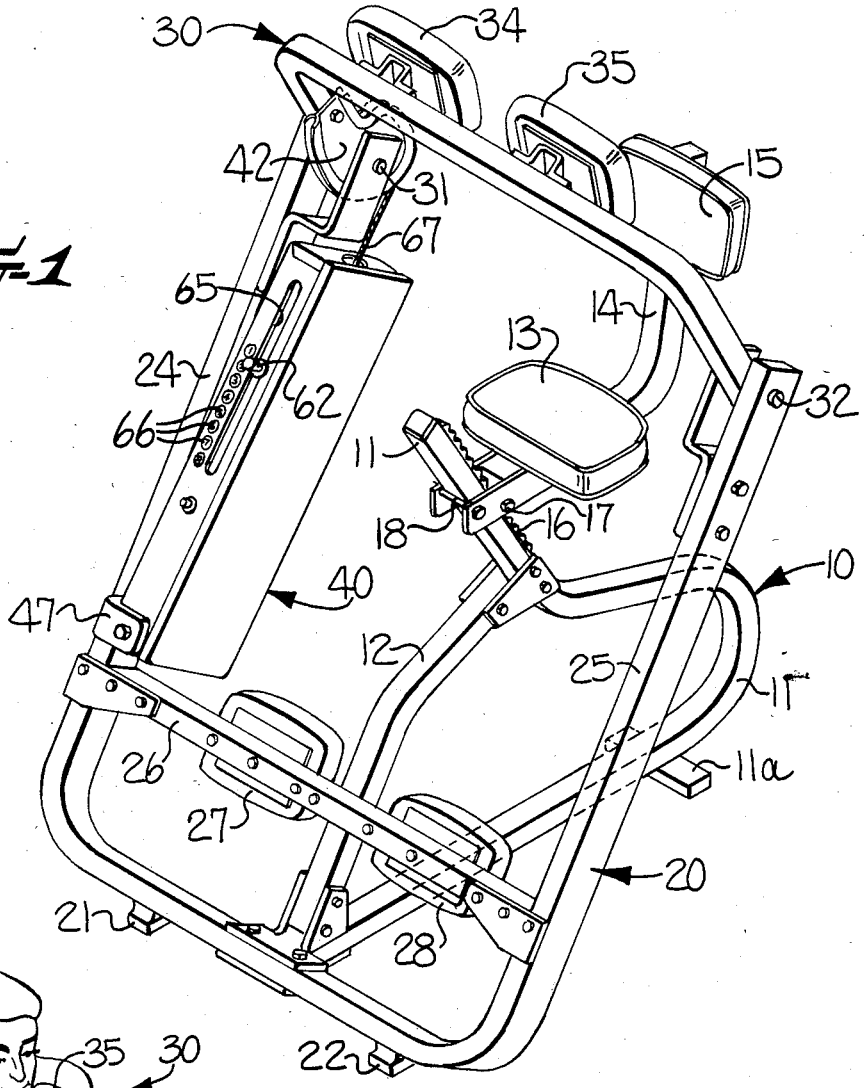
FIG. 1 is an isometric view of the abdominal exercising machine.
Figure 2:
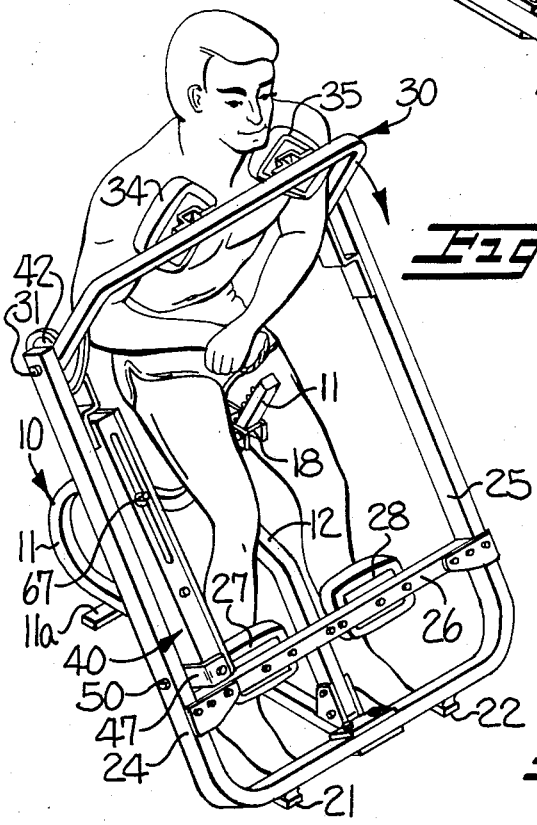
FIG. 2 is an isometric view of the abdominal exercising machine shown in FIG. 1 and looking from the opposite side thereof with the user being positioned to begin the exercising movement.
Figure 3:
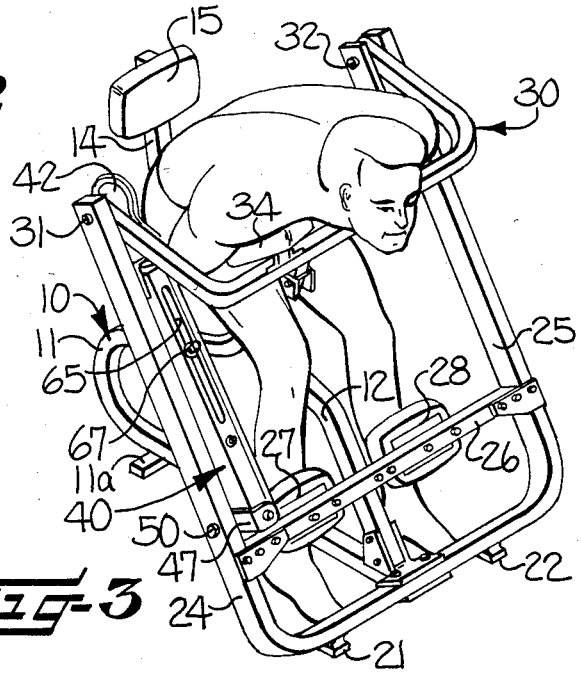
FIG. 3 is a view similar to FIG. 2 but showing the user moved forwardly to the forward position of movement of the exercising lever.

As illustrated in FIGS. 1-3, the present abdominal exercising machine includes an upstanding main frame section, broadly indicated at 10, and including front, rear, upper and lower portions. The main frame section 10 includes a first tubular frame member 11 having a horizontal portion extending along and spaced above the floor or the like by a cross leg 11*a*. The rear portion of the frame member 11 is curved and extends forwardly and then upwardly. The upper portion of the first frame member 11 is connected to the upper portion of a second frame member 12, the lower end of which is connected to the forward end of the horizontal portion of the frame member 11.

A seat 13 is supported on the horizontal portion of a seat support frame member 14 and the upper portion is provided with a backrest 15. The seat 13, frame member 14 and backrest 15 are supported on the upper portion of the frame member 11 for vertical adjustment. To this end, a racklike member 16 is fixed on the rear side of the upstanding portion of the frame member 11 and is adapted to be engaged by a suitable transverse pin 17 carried by the forward portion of the seat support frame member 14. A transverse pin 18 extends across the forwardly extending portions of the frame member 14 and engages the other side of the frame member 11. Thus, the position of the seat 13 can be varied by tilting the seat 13 upwardly and forwardly so that the pin 18 is out of engagement with the forward portion of the frame member 11 and the pin 17 is out of engagement with the racklike member 16. When the proper vertical position is located, the seat 13 is then lowered so that the pin 17 engages the racklike member 16 and the pin 18 engages the forward portion of the frame member 11.

A substantially U-shaped auxiliary frame, broadly indicated at 20, is fixed at its lower medial portion to the front portion of the main frame 10 and is provided with suitable feet 21, 22 for supporting the auxiliary frame 20 on the floor or the like. The auxiliary frame 20 includes upstanding legs 24, 25 extending rearwardly at an acute angle and forwardly of the seat 13. The upstanding legs 24, 25 include upper free ends terminating above the level of the seat 13 and corresponding with the level of the waist of the user when positioned on the seat 13. The auxiliary frame 20 also includes a cross brace 26 fixed at opposite ends to the lower portions of the respective legs 24, 25 and supporting cushioned pads 27, 28 for engaging the shin portion of the leg of the user when performing exercising movements on the machine.

A substantially U-shaped exercising lever, broadly indicated at 30, is provided with the opposite end portion of the legs thereof being pivotally connected to the upper ends of the upstanding legs 24, 25 of the auxiliary frame 20. The opposite ends of the legs of the U-shaped exercising lever 30 are pivotally supported on the upstanding legs 24, 25 as by respective pivot bolts 31, 32. Cushioned pads 34, 35 are supported for adjustment on the medial portion of the U-shaped exercising lever 30 to be adjusted to comfortably engage the front portions of the shoulders or chest of the user, as illustrated in FIG. 2.

Resistance force means, broadly indicated at 40, is operatively connected to the exercising lever 30 for resisting movement of the exercising lever forwardly and downwardly in a positive exercising movement and for applying a resistance force to the upper body of the user when moving upwardly and rearwardly to an upright seated position during a negative exercising movement. It is preferred that a variable radius cam 42 be operatively interposed between the resistance force means 40 and the exercising lever 30 so that the amount of resistance force required to move the exercising lever 30 is varied throughout the pivotal arc of movement of the exercising lever. As best shown in FIG. 1, the variable radius cam 42 is secured to the inner surface of one leg of the exercising lever 30.

Figure 4:
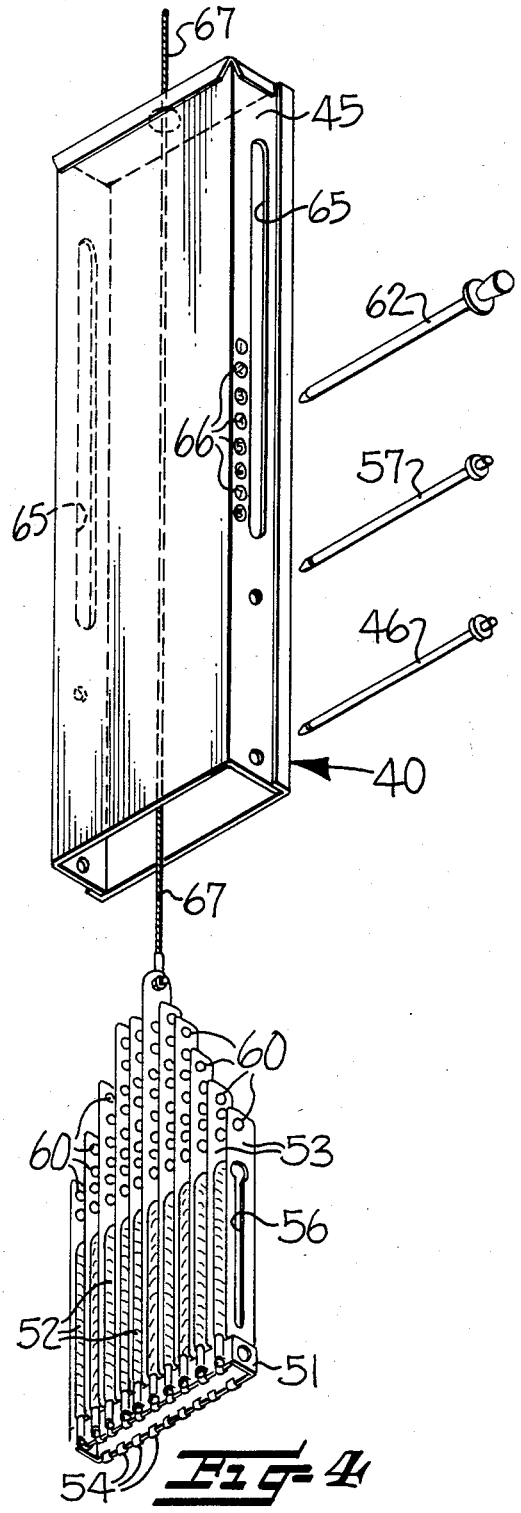
FIG. 4 is an exploded isometric view of the resistance force means.
Figure 5:
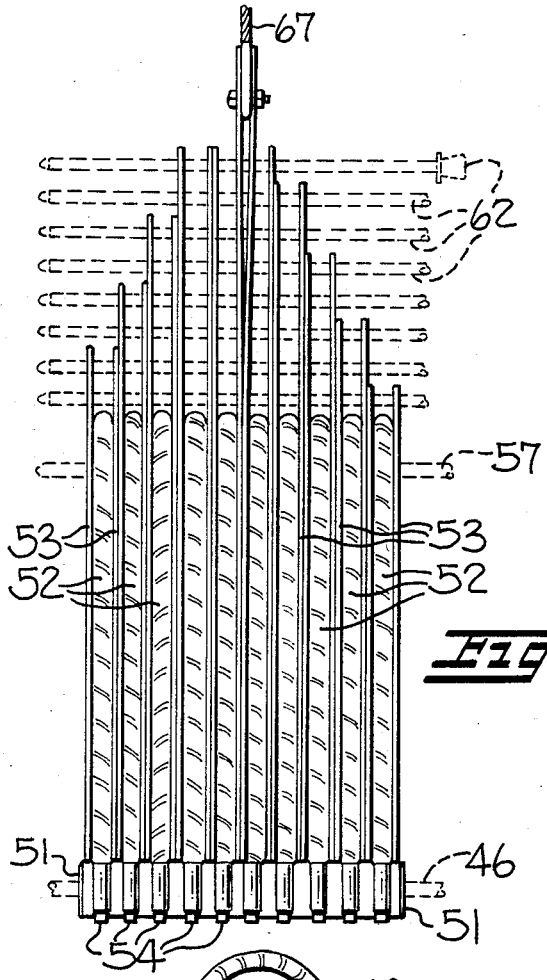
FIG. 5 is an elevational view of the plurality of side-by-side elastic cord members forming the resistance force means.
Figure 6:
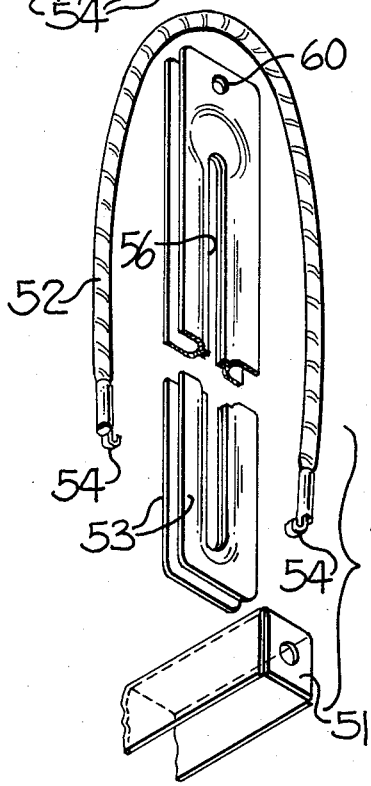
FIG. 6 is a fragmentary exploded isometric view illustrating one of the U-shaped elastic cord members and the associated cord retaining and guide member.

While the resistance force means 40 may be any one of the well-known types heretofore mentioned, it is preferred that the resistance force means 40 include elongate resilient means of the type illustrated in FIGS. 4–6. The resistance force means 40 includes an elongate rectangular housing 45 with its lower end being supported on the leg 24 of the auxiliary frame 20 by an anchor pin 46 extending through the housing 45 and the opposite end legs of a U-shaped pivot bracket 47. The medial portion of the pivot bracket 47 is pivotally supported by a bolt 50 extending through the leg 24 of the auxiliary frame 20 (FIGS. 2 and 3).

The anchor pin 46 also passes through opposite ends of an anchor support bracket 51 which is substantially U-shaped in cross section and spans the distance across the lower end of the housing 45. A plurality of elongate resilient members are positioned in side-by-side relationship in the housing 45. The elongate resilient means are indicated at 52 and each comprises an elastic cord of the type known as a "bunge" cord which is maintained in a substantially U-shaped configuration by a corresponding retaining and guide member 53 formed of a pair of stamped sheet metal plates. The central portions of the stamped sheet metal plates forming the retaining and guide members 53 are depressed inwardly and connected together to form flanges extending along the outer peripheral surfaces thereof. The cord 52 fits between the flanges and opposite ends are provided with hook members 54 which are connected around and held in position on the lower opposite edges of the anchor support bracket 51.

An elongate slot 56 is formed in the medial portion of the elastic cord retaining and guide members 53 and a guide pin 57 extends through opposite sides of the housing 45 and through the slots 56 in each of the cord retaining and guide members 53. As best shown in FIGS. 4 and 5, the upper end portions of the cord retaining and guide members 53 progressively vary in length from one side of the resistance force means 40 to the other and include variable numbers of spaced-apart selector pin engaging openings 60 therein.

A manually insertable selector pin 62 is provided for selectively engaging and penetrating the selector pin engaging openings 60 in the cord retaining and guide members 53 to thereby vary the resistance force required to move the exercising lever 60 back and forth between the position shown in FIGS. 2 and 3. The selector pin 62 is positioned in the housing 45 through opposite side slots 65 with suitable numerals or other indicia 66 spaced along the slot 65 to indicate the position in which the selector pin should be positioned or inserted to vary the resistance force required to move the exercising lever 30.

As will be noted in FIG. 5, the adjacent innermost metal plates of the two centrally located cord retaining and guide members 53 extend to a higher level than the ends of the adjacent metal plates and are connected to the lower end of a force transmitting cable 67. The medial portion of the cable 67 extends through an opening in the upper end of the housing 45 and its upper end is connected to the variable radius cam 42. When the selector pin 62 is positioned in the upper dotted line position shown in FIG. 5, it will penetrate the selector pin engaging openings 60 in the two central cord retaining and guide members 53 plus one cord retaining and guide member 53 to the left of these two central ones. With the selector pin 62 in this position, the resistance force applied to the exercising lever 30 will be equal to the resistance force of three of the elastic cords 52.

When the selector pin 62 is moved downwardly to penetrate the second pin engaging openings from the upper ends of the cord retaining and guide members 53, as shown in the second from the top dotted line position in FIG. 5, the resistance force required to move the exercising lever 30 is determined by the two central elastic cords 52 and the elastic cords 52 on opposite sides thereof so that the total resistance force is equal to the combined resistance force of the four central elastic cords 52. Thus, the movement of the selector pin 62 varies the effective length of the elastic cords 52 and thereby varies the amount of force required to move the exercising lever 30.

As the selector pin 62 is moved downwardly one additional position, the resistance force is increased by one additional elastic cord 52 until the selector pin 62 is moved to the lowermost dotted line position shown in FIG. 5 where it engages and penetrates the pin engaging openings in each of the cord retaining and guide members 53 so that the resistance force required to move the exercising lever 30 is equal to the resistance force of all ten of the elastic cords 52. It is to be understood that the configuration of the variable radius cam 42 can be varied to apply the proper amount of resistance force to the exercising lever 30 during various positional movements, regardless of the number of elastic cords 52 which are connected to the cable 67.

The present exercising machine is formed of a relatively lightweight construction so that it is particularly adapted for home use, as opposed to the heavier commercial types of machines normally used in exercising centers. The use of the elastic cord type of resistance force applying means contributes to the lightweight construction of the machine and provides the proper amount of variable resistance, depending upon the physical condition, size and strength of the user. The variable radius cam provides that a variable amount of resistance force is applied to the exercising lever throughout the pivotal arc of movement during each exercising movement, regardless of the number of elastic cord elements which are operatively connected to the exercising lever.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. An exercising machine including a frame, support means on said frame for supporting the user thereon, exercising lever means including one end supported for pivotal movement on said frame and an opposite end adapted to be engaged by a portion of the body of the user and movable in an arcuate path between first and second positions, elongate resilient means including one end connected in fixed relationship to said frame and an opposite end connected to said exercising lever means, said elongate resilient means normally being in contracted condition to maintain said exercising lever means in said first position of the arcuate path, said elongate resilient means being stretchable by the user applying pressure to said other end of said exercising lever means to move said exercising lever means to said second position, and selector means operatively engageable along the effective length of said elongate resilient means for varying the effective length of said elongate resilient means to thereby vary the amount of resistance force required to move said exercising lever means a given amount of pivotal movement.

2. An exercising machine according to claim 1 and including variable radius cam means operatively interposed between said elongate resilient means and said exercising lever means so that the amount of resistance force required to move said exercising lever means is varied throughout the pivotal arc of movement of said exercising lever means.

3. An exercising machine according to claim 1 wherein said elongate resilient means includes a plurality of spaced-apart openings associated therewith and comprises a plurality of side-by-side elastic cord members, and wherein said selector means is manually operable and includes selector pin means selectively engageable with said openings for operatively connecting a selected member of said elastic cord members to said exercising lever means.

4. An exercising machine according to claim 3 including an elongate retaining and guide member associated with each of said elastic cord members, said elongate retaining and guide member retaining said elastic cord members in a U-shaped configuration and including an extension extending beyond the closed end of said elastic cord members, and wherein said openings for reception of said selector means are formed in said extension of said retaining and guide member.

5. An exercising machine according to claim 4 including an elongate rectangular housing supported for pivotal movement at one end on said frame, and wherein said elastic cord members and said retaining elongate and guide members are supported inside of said housing.

6. An exercising machine according to claim 5 including an anchor support bracket extending across said one end of said housing, and wherein opposite ends of each of said elastic cord members are fixed on said anchor support bracket.

7. An exercising machine according to claim 6 including an elongate guide slot in each of said retaining elongate and guide members, and a guide pin supported at opposite ends in opposite sides in said housing with the medial portion of said guide pin extending through said elongate guide slot in each of said elongate retaining and guide members.

8. An exercising machine according to claim 6 wherein each of said elongate retaining and guide members comprises a pair of formed plates, wherein the central portions of said formed plates are depressed inwardly and connected together to form flanges extending along the peripheral surfaces thereof, and wherein said elastic cord member extends along and is retained in the peripheral flanges of said elongate retaining and guide member.

9. An exercising machine according to claim 4 including a force transmitting cable connected at one end to at least one of said elongate retaining and guide members and being operatively connected at its other end to said exercising lever means, and wherein said selector means comprises a selector pin movable to a plurality of positions to penetrate said openings in a selected number of said retaining and guide members to operatively connect the same to said retaining and guide members connected to said force transmitting cable and to thereby vary the amount of resistance force resisting movement of said exercising lever means.

10. An exercising machine particularly adapted for exercising the abdominal muscles of the user and comprising an upstanding main frame section including front, rear, upper and lower portions, said lower portion being supported on a floor or the like, a seat supported on the upper portion of said upstanding main frame, a substantially U-shaped auxiliary frame fixed at its lower medial portion to the front portion of said main frame and including upstanding legs extending rearwardly at an acute angle and forwardly of said seat, said legs including upper ends terminating above the level of said seat and corresponding with the level of the waist of the user, a substantially U-shaped exercising lever having opposite end portions of the legs thereof pivotally connected to the upper ends of said upstanding legs of said auxiliary frame, said exercising lever including pad means positioned on the medial portion thereof for engagement by the shoulders of the user, said exercising lever normally being positioned in substantially a right-angular relationship with said upstanding legs of said auxiliary frame and with said pad means in position to be engaged by the shoulders of the user when in an upright seated position on said seat, and resistance force means operatively connected to said exercising lever for resisting movement of said exercising lever forwardly and downwardly in a positive exercising movement.

11. An exercising machine according to claim 10 including variable radius cam means operatively interposed between said resistance force means and said exercising lever so that the amount of resistance force required to move said exercising lever is varied throughout the pivotal arc of movement of said exercising lever in a positive exercising movement.

12. An exercising machine according to claim 10 including adjustment means for adjusting the vertical level of said seat on said main frame.

13. An exercising machine according to claim 10 wherein said resistance force means comprises elongate resilient means including one end fixed on said auxiliary frame and an opposite end operatively connected to said exercising lever.

14. An exercising machine according to claim 13 wherein said elongate resilient means comprises a plurality of side-by-side elastic cord members, and including manually operable selector means selectively engageable with a selected number of said elastic cord members for connecting the same to said exercising lever.

15. An exercising machine according to claim 14 including an elongate retaining and guide member associated with each of said elastic cord members, said elongate retaining and guide member retaining said elastic cord members in a U-shaped configuration with a closed end, said elongate retaining and guide member including an extension extending beyond the closed ends of said elastic cord members, and including openings in said extension for reception of said selector means.

16. An exercising machine according to claim 15 including an elongate rectangular housing means for supporting said elongate rectangular housing for pivotal movement at one end on one of said upstanding legs of said auxiliary frame, and wherein said elastic cord members and said elongate retaining and guide members are supported inside of said housing.

17. An exercising machine according to claim 16 including an anchor support bracket extending across said one end of said elongate rectangular housing, and wherein opposite ends of each of said elastic cord members are fixed on said anchor support bracket.

18. An exercising machine according to claim 17 including an elongate guide slot in each of said elongate retaining and guide members, and a guide pin supported at opposite ends in opposite sides in said elongate rectangular housing with the medial portion of said guide pin extending through said elongate guide slot in each of said elongate retaining and guide members.

19. An exercising machine according to claim 18 wherein each of said retaining and guide members comprises a pair of formed plates, wherein the central portions of said formed plates are depressed inwardly and connected together to form flanges extending along the peripheral surfaces thereof, and wherein the elastic cord member extends along and is retained in the peripheral flanges of said elongate retaining and guide member.

20. An exercising machine according to claim 19 including a force transmitting cable connected at one end to at least one of said elongate retaining and guide members and being operatively connected at its other end to said exercising lever, and wherein said selector means comprises a selector pin movable to a plurality of positions to penetrate said openings in a selected number of said elongate retaining and guide members to operatively connect the same to said elongate retaining and guide member connected to said force transmitting cable and to thereby vary the amount of resistance force resisting movement of said exercising lever.

* * * * *

UNITED STATES PATENT AND TRADEMARK OFFICE

CERTIFICATE OF CORRECTION

PATENT NO. : 4,600,196

DATED : July 15, 1986

INVENTOR(S) : Arthur A. Jones

It is certified that error appears in the above-identified patent and that said Letters Patent are hereby corrected as shown below:

Claim 4, Column 7, Line 40, before "retaining" insert -- elongate --.

Claim 5, Column 7, Line 44, "retaining elongate" should be -- elongate retaining --.

Claim 7, Column 7, Line 52, "retaining elongate" should be -- elongate retaining --.

Claim 9, Column 8, Line 6, before "retaining" insert -- elongate --.

Claim 9, Column 8, Line 7, before "retaining" insert -- elongate --.

Signed and Sealed this

Seventh Day of October, 1986

[SEAL]

*Attest:*

DONALD J. QUIGG

*Attesting Officer*

*Commissioner of Patents and Trademarks*